US011160377B2

(12) United States Patent
Bock et al.

(10) Patent No.: US 11,160,377 B2
(45) Date of Patent: Nov. 2, 2021

(54) SYNCHRONOUS CHAIR MECHANISM AND CHAIR HAVING SAME

(71) Applicant: VITRA PATENTE AG, Birsfelden (CH)

(72) Inventors: Hermann Bock, Pyrbaum (DE); Thomas Schneider, Schwörstadt (DE); Thomas Kamber, Basel (CH)

(73) Assignee: VITRA AG, Birsfelden (CH)

( * ) Notice: Subject to any disclaimer, the term of this patent is extended or adjusted under 35 U.S.C. 154(b) by 97 days.

(21) Appl. No.: 16/342,941

(22) PCT Filed: Oct. 17, 2017

(86) PCT No.: PCT/EP2017/076437
§ 371 (c)(1),
(2) Date: Apr. 17, 2019

(87) PCT Pub. No.: WO2018/073222
PCT Pub. Date: Apr. 26, 2018

(65) Prior Publication Data

US 2020/0046120 A1 Feb. 13, 2020

(30) Foreign Application Priority Data

Oct. 18, 2016 (EP) ..... 16194443

(51) Int. Cl.
*A47C 1/032* (2006.01)

(52) U.S. Cl.
CPC ..... *A47C 1/03266* (2013.01); *A47C 1/03205* (2013.01); *A47C 1/03272* (2013.01); *A47C 1/03277* (2013.01)

(58) Field of Classification Search
CPC ..... A47C 1/03266; A47C 1/03272; A47C 1/03205
See application file for complete search history.

(56) References Cited

U.S. PATENT DOCUMENTS 5,026,117 A * 6/1991 Faiks ..... A47C 3/026 267/131
2004/0140702 A1 7/2004 Daeschle et al.
(Continued)

FOREIGN PATENT DOCUMENTS

EP 1 358 821 A1 5/2003
EP 1 440 632 A1 7/2004
(Continued)

OTHER PUBLICATIONS

International Search Report dated Dec. 13, 2017 in corresponding International Patent Application No. PCT/2017/076437.

*Primary Examiner* — Timothy J Brindley
(74) *Attorney, Agent, or Firm* — Medler Ferro Woodhouse & Mills PLLC

(57) ABSTRACT

A synchronous chair mechanism is disclosed for simultaneously changing a seat and a backrest of a chair from a zero position in which the backrest is tilted to a minimum extent relative to the seat, into an end position in which the backrest is tilted to a maximum extent relative to the seat. The synchronous chair mechanism includes a base that is connectable to a substructure provided for setting up the chair. The synchronous chair mechanism also includes a backrest carrier on which the backrest is mountable, a seat support that is designed for holding a seat, and a spring element having a front end and a rear end.

16 Claims, 7 Drawing Sheets

ZEICHNUNGEN

(56) References Cited

U.S. PATENT DOCUMENTS

| | | | | |
|---|---|---|---|---|
| 2009/0267394 | A1* | 10/2009 | Bock | A47C 31/126<br>297/300.2 |
| 2009/0302655 | A1* | 12/2009 | Gorgi | A47C 1/03266<br>297/303.1 |
| 2018/0279785 | A1* | 10/2018 | Moreschi | A47C 1/03266 |
| 2019/0038033 | A1* | 2/2019 | Schmitz | A47C 1/03266 |
| 2020/0268155 | A1* | 8/2020 | Brais | A47C 1/03277 |

FOREIGN PATENT DOCUMENTS

| | | | |
|---|---|---|---|
| EP | 2 774 511 | A1 | 9/2014 |
| WO | 2008/110669 | A1 | 9/2008 |

* cited by examiner

ZEICHNUNGEN

SYNCHRONOUS CHAIR MECHANISM AND CHAIR HAVING SAME

TECHNICAL FIELD

The invention relates to a synchronous chair mechanism according to the preamble of independent claim 1, and a chair having such a synchronous chair mechanism.

Synchronous chair mechanisms having a base that is connectable to a substructure provided for setting up the chair, a backrest carrier on which the backrest is mountable, a seat support that is designed for holding a seat, and a spring element having a front end and a rear end, wherein the backrest carrier is mounted on the base so as to be pivotable about a first rotational axis, the seat support is connected to the backrest carrier so as to articulate about a second rotational axis, and is connected to the front end of the spring element so as to articulate about a third rotational axis, and the rear end of the spring element is hinged to the backrest carrier via a fourth rotational axis, may be used for simultaneously changing a seat and a backrest of a chair from a zero position in which the backrest is tilted to a minimum extent relative to the seat, into an end position in which the backrest is tilted to a maximum extent relative to the seat.

BACKGROUND

To achieve a high level of seating comfort and good seat ergonomics, chairs nowadays are frequently adaptable in various ways to the circumstances of users and their preferred uses. In particular for work chairs and office chairs, on which the user sits for relatively long periods of time, adjustability may be of great importance. For example, most current office chairs are at least height-adjustable and rotatable. Thus, they may be adjusted to a preferred seat height of the user and an appropriate orientation.

In addition, many chairs, in particular office chairs, have a backrest that may be inclined or tilted with respect to the seating surface in a variable manner. Such chairs allow the user to change between an upright sitting position in which the backrest is quasi-vertical, into a relaxing position in which the backrest is tilted backward. It is often desirable for the seating surface itself to likewise tilt to a certain extent during tilting or adjustment of the backrest. For this purpose, chairs may be equipped with synchronous chair mechanisms that ensure that the seat and the backrest are simultaneously adjusted relative to one another in the preferred manner.

For example, EP 1 039 816 B1 describes an office chair with a synchronous chair mechanism, comprising a base, a backrest carrier, a seat support, and a suspension system. A seat of the office chair is mounted on the seat support, a backrest is mounted on the backrest carrier, and a height-adjustable underframe is mounted on the base. The backrest carrier is fastened to the base so as to be pivotable about a first rotational axis. The seat support is connected to the backrest carrier with articulation about a second rotational axis, and is connected to the suspension system with articulation about a third rotational axis. The suspension system is also hinged to the base via a fourth rotational axis by means of a front lever. The suspension system is designed as a torsion spring that generates a torque on the seat support about the third rotational axis.

Further similar synchronous chair mechanisms are known in which the suspension system is designed as a linear suspension system. The linear suspension system is typically clamped between two mutually movable or hinged components, and generates a torque on at least one of the rotational axes. The linear suspension system may thus define a supporting force of the backrest. The synchronous chair mechanisms are also sometimes designed to allow the supporting force of the backrest to be adjusted. For this purpose, pretensioning of the linear suspension system may be adjusted in a known manner, for example via a length-adjustable threaded spindle.

However, known synchronous chair mechanisms are typically relatively limited in the extent of adjustability of the supporting force of the backrest. In addition, the pretensioning of linear suspension systems in synchronous chair mechanisms may decrease the range of motion of the linear springs. Furthermore, relatively large forces are necessary for pretensioning the linear suspension systems that are strong enough to support the user. For this reason, control mechanisms are provided, which are relatively complicated to operate. When threaded spindles are used, for example the thread has a flat design, so that the spindle has to make a relatively large number of revolutions until the elastic force is noticeably changed. In addition, known control mechanisms often do not have sufficient stability, so that they may carry out the adjustment abruptly or sluggishly.

The object of the present invention, therefore, is to propose a chair and a synchronous chair mechanism that allow relatively simple, convenient, and reliable adjustment of the supporting force of the backrest.

DESCRIPTION OF THE INVENTION

The object is achieved according to the invention by a synchronous chair mechanism as defined in independent claim 1. Advantageous embodiment variants of the invention result from the dependent claims.

The essence of the invention is as follows: A synchronous chair mechanism for simultaneously changing a seat and a backrest of a chair from a zero position in which the backrest is tilted to a minimum extent relative to the seat, into an end position in which the backrest is tilted to a maximum extent relative to the seat, has a spring element and multiple basic elements. The basic elements include a base that is connectable to a substructure provided for setting up the chair, a backrest carrier on which the backrest is mountable, and a seat support that is designed for holding a seat. The seat support may have a rear side that may face the backrest and a front side that may face away from the backrest. The spring element has a front end and a rear end, and is operatively connected to at least two of the basic elements.

The synchronous chair mechanism also includes a latching structure that is provided on one of the basic elements, and a slide coupling piece. The slide coupling piece is pivotably mounted on the front end of the spring element or on the rear end of the spring element. Outside the zero position of the synchronous chair mechanism, the slide coupling piece engages with the latching structure so that the slide coupling piece and the latching structure are fixedly connected to one another. In the zero position of the synchronous chair mechanism, the slide coupling piece is decoupled from the latching structure so that the slide coupling piece is movable relative to the latching structure, as the result of which an action of the spring element may be changed.

In the zero position of the synchronous chair mechanism or of the chair, the seat, and thus typically also a top side of the seat support, is generally oriented horizontally or quasi-horizontally. In this position, the backrest is tilted to a minimum extent relative to the seat; i.e., an angle between the seat and the backrest is at a minimum. In this context, the term "minimum angle" means that the provided or intended range of motion of the synchronous chair mechanism does not allow a smaller angle. In the end position, the angle between the seat and the backrest is at a maximum. The term "maximum angle" means that the provided or intended range of motion of the synchronous chair mechanism does not allow a larger angle.

In conjunction with the chair or the synchronous chair mechanism, the term "outside the zero position" refers to a position in which the backrest is not tilted to a minimum extent relative to the seat. That is, the angle between the seat and the backrest outside the zero position is not minimal. Outside the zero position, the angle between the seat and the backrest may be at a maximum, or between a maximum and a minimum. In positions outside the zero position, in this sense the backrest is tilted so far relative to the seat that decoupling of the slide coupling piece is possible. A very small degree of tilting that is not sufficient for such decoupling is not understood as outside the zero position in this sense.

The rear side of the seat support may be turned toward, i.e., facing, the backrest when the synchronous chair mechanism is installed in the chair. When a person sits on the chair, the rear side of the seat support is situated near the transition from the back to the buttocks of the person. The rear side of the seat support is thus formed by its rear end.

Similarly as for the rear side of the seat support, its front side may be turned toward, i.e., facing, the backrest when the synchronous chair mechanism is installed in the chair. When the person sits on the chair, the front side of the seat support is situated near the thighs of the person. The front side of the seat support is thus formed by its front end.

In the context of the invention, the action of the spring element may be understood to mean an effect of the spring element on the at least two basic elements to which the spring element is operatively connected. The action may correspond to a force or a torque exerted by the spring element on at least one of the basic elements. For example, a change in the force induced by the spring element or in the torque generated by the spring element may be produced via the change in the action. For example, the spring element may act in such a way that it exerts a torque on both the backrest carrier and the seat support. The way in which the backrest and the seat may be moved synchronously relative to one another may thus be influenced by means of the spring element.

The spring element may in particular be configured in such a way that an elastic force acts between its front end and its rear end. The elastic force may act quasi-linearly. For example, the spring element may include a coil spring, an elastic spring, a hydraulic spring, or a similar spring; when this spring is compressed, the front end and the rear end are pressed together, and when this spring is expanded, the front end and the rear end are moved or pulled away from one another. To be able to provide a sufficient or suitable elastic force, the spring element may in particular include a spring assembly, i.e., a plurality of springs.

A lever that acts between the spring element and the backrest carrier may be lengthened and shortened by moving the slide coupling piece relative to the latching structure. This lever is also referred to below as an "effective lever" or "active lever." The action of the spring element and in particular a torque generated by the spring element on at least one of the basic elements may likewise be changed and adjusted by adjusting the active lever. The chair may thus be conveniently and precisely adjusted, for example, to the weight of a user and the supporting force of the backrest by means of the chair mechanism according to the invention. In particular, the force necessary for tilting the backrest may thus be adapted to the user by moving the suspension system relative to the backrest carrier and adjusting the active lever.

It may also be ensured via the slide coupling piece and the latching structure that adjusting the distance between the first and fourth rotational axes is possible only when the backrest is under no load or essentially no load, and therefore is not tilted. As soon as the backrest is tilted, the slide coupling piece is coupled and the effective lever arm is fixed. This allows reliable, efficient adjustment of the chair, and in particular of the restoring force of its backrest. In addition, the latching structure allows quasi-continuous adjustment or fine adjustment of the lever arm.

The slide coupling piece may thus allow on the one hand coupling, in which it is engaged with the latching structure, and on the other hand, sliding when it is disengaged from the latching structure. The slide coupling piece in particular allows the active lever to be adjusted via a sliding motion when the synchronous chair mechanism is in the zero position.

In one preferred embodiment the synchronous chair mechanism has the following design: The backrest carrier is mounted on the base so as to be pivotable about a first rotational axis. The seat support is connected to the front end of the spring element with articulation about a third rotational axis. The rear end of the spring element is hinged to the backrest carrier via a fourth rotational axis. The first rotational axis, the third rotational axis, and the fourth rotational axis are different from one another.

This embodiment allows efficient synchronous adjustment of the backrest carrier relative to the seat support, or in an installed state, efficient synchronous adjustment of the backrest relative to the seat. In particular, the synchronous chair mechanism according to the invention may be implemented with a robust construction having a relatively simple design.

The latching structure is preferably provided on the backrest carrier. The slide coupling piece is preferably mounted on the rear end of the spring element so as to be pivotable about the fourth rotational axis. In particular, the rear end of the spring element is thus indirectly connected to the backrest carrier via the slide coupling piece, with articulation about the fourth rotational axis. With such a configuration, the spring element, even in the zero position, may be displaceably connected to another of the basic elements, in particular the backrest carrier. The spring element may thus be oriented or positioned with respect to the other basic elements so that its action may be efficiently adjusted.

In the zero position of the synchronous chair mechanism, the slide coupling piece is preferably decoupled from the latching structure of the backrest carrier so that the slide coupling piece is movable relative to the latching structure, as the result of which a distance between the fourth rotational axis and the first rotational axis may be changed in order to change the action of the spring element. This distance may in particular define the effective lever or active lever, or correspond to same. The change in the action of the spring element may thus be made easily and precisely.

The seat support is preferably connected to the backrest carrier with articulation about a second rotational axis. This may allow efficient and targeted tilting of the backrest carrier relative to the seat support.

The rear side of the seat support is situated closer to the second rotational axis than to the third rotational axis. Similarly, the front side of the seat support is situated closer to the third rotational axis than to the second rotational axis.

The synchronous chair mechanism preferably has a connecting arm that is mounted on the seat support so as to be pivotable about the third rotational axis, wherein the spring element is connected to the connecting arm so as to be pivotable about a fifth rotational axis that is different from the first rotational axis, the third rotational axis, and the fourth rotational axis. The connecting arm is preferably mounted on the base so as to be pivotable about a sixth rotational axis. Such a connecting arm allows a gentle movement or simultaneous tilting of the seat support when the backrest carrier is tilted. The seat of the chair may thus be tilted and moved backward in an ergonomic movement when the backrest is tilted backward.

A mating sliding surface against which the slide coupling piece rests when the synchronous chair mechanism is in the zero position is preferably formed on one of the basic elements that is different from the basic element provided with the latching structure. It may thus be ensured that the slide coupling piece is always in contact with one of the basic elements, and thus may always be supported. The slide coupling piece together with the spring element may thus always be supported in a stable manner. Play and possible accompanying instability of the mechanism may be avoided in this way.

The base preferably has a base sliding surface and the slide coupling piece preferably has a mating sliding surface, wherein in the zero position of the synchronous chair mechanism, the mating sliding surface of the slide coupling piece rests against the base sliding surface of the base. The base sliding surface and mating sliding surface preferably have a low-friction design. As a result of the base sliding surface and mating sliding surface resting against one another in the zero position, the slide coupling piece may be moved relatively easily along the backrest carrier. The effective lever may thus be adjusted relatively easily and conveniently. In addition, the base surface may act on the mating sliding surface in such a way that the slide coupling piece is decoupled from the latching structure of the backrest carrier.

The latching structure preferably has a tooth row and the slide coupling piece preferably has an engagement tooth, wherein outside the zero position of the synchronous chair mechanism, the engagement tooth of the slide coupling piece engages with the tooth row of the latching structure. Such a tooth row-engagement tooth combination allows relatively efficient coupling of the slide coupling piece and the backrest carrier. The slide coupling piece and the backrest carrier may thus be reliably fixedly connected to one another outside the zero position.

Outside the zero position of the synchronous chair mechanism, the mating sliding surface of the slide coupling piece is preferably spaced apart from the base sliding surface of the base, and in the zero position of the synchronous chair mechanism the engagement tooth of the slide coupling piece is preferably spaced apart from the tooth row of the backrest carrier. A change may thus be efficiently made between the fixed connection of the slide coupling piece, and thus optionally the spring element and the backrest carrier, and the displaceable or movable connection of the slide coupling piece.

To allow the coupling between the slide coupling piece and the backrest carrier to be secure and stable in any rotational position of the backrest carrier about the first rotational axis outside the zero position, the slide coupling piece may be mounted on the rear end of the spring element so as to be rotatable about the sixth rotational axis. It may thus be ensured, for example, that the engagement tooth engages precisely and securely with the tooth row outside the zero position.

The fourth rotational axis is preferably formed by an axial rod, wherein the axial rod is connected to the rear end of the spring element, the slide coupling piece has an axial bore, and the axial rod extends into the axial bore of the slide coupling piece. The above-mentioned mounting of the slide coupling piece on the spring element so as to be rotatable about the fourth rotational axis may thus be efficiently provided.

In one preferred embodiment, the axial bore of the slide coupling piece is designed in such a way that the slide coupling piece is tiltable about a tilt axis that is angled with respect to the fourth rotational axis. The tilt axis may in particular extend quasi-perpendicularly with respect to the fourth rotational axis. As a result, the slide coupling piece may be tilted on the axial rod in a bell-like manner for the coupling and decoupling. In particular, in the zero position of the synchronous chair mechanism this allows the slide coupling piece to be hinged to the axial rod in a first tilt position in which the synchronous chair mechanism is decoupled from the backrest carrier. Outside the zero position, the slide coupling piece may be situated on the axial rod in a second tilt position, and in this position may be coupled to the backrest carrier. This allows a robust design of the coupling mechanism between the slide coupling piece and the backrest carrier.

The slide coupling pieces preferably have a rounded first contact surface, and the backrest carrier preferably has a correspondingly rounded second contact surface, wherein the first contact surface of the slide coupling piece and the second contact surface of the backrest carrier rest against one another in different positions in the zero position and outside the zero position. Such rounded contact surfaces allow precise guiding of the slide coupling piece relative to the backrest carrier during tilting on the axial rod. Secure coupling and decoupling of the slide coupling piece with/from the backrest carrier may be achieved in this way.

The first contact surface of the slide coupling piece is preferably situated next to the engagement tooth, and the second contact surface of the backrest carrier preferably extends in parallel to the tooth row of the latching structure. This allows efficient implementation of the coupling mechanism.

The synchronous chair mechanism preferably includes a control device via which the slide coupling piece is movable along the latching structure in the zero position of the synchronous chair mechanism, so that a distance between the first rotational axis and the fourth rotational axis may be changed. Such a control device may allow convenient operation of the synchronous chair mechanism.

The control device preferably includes a rotary lever that is rotatably connected to the backrest carrier, a gearwheel situated on the rotary lever, and a gearwheel receptacle with toothing that is fixedly connected to the fourth rotational axis, the gearwheel engaging with the toothing of the gearwheel receptacle so that rotation of the rotary lever results in displacement of the fourth rotational axis relative to the backrest carrier. Since the slide coupling piece is decoupled from the latching structure of the backrest carrier in the zero position of the synchronous chair mechanism, in this position the slide coupling piece may be moved along the latching structure due to actuation of the rotary lever, and the distance between the first and second rotational axes may thus be changed. Outside the zero position, the slide coupling piece engages with the latching structure of the backrest carrier, thus blocking actuation or rotation of the rotary lever.

In one possible embodiment, the fourth rotational axis is situated between the first rotational axis and the second rotational axis. In such a configuration the spring element is stretched during a deflection of the backrest. The spring element correspondingly acts with a tensile force against the deflection of the backrest. However, in another preferred embodiment the first rotational axis is situated between the second rotational axis and the fourth rotational axis. In such a configuration the spring element is compressed during a deflection of the backrest, and thus acts with a compressive force against the deflection of the backrest. This allows a relatively simple and stable implementation of the spring element in a compact design.

The synchronous chair mechanism preferably includes a further backrest carrier and a further slide coupling piece, wherein the backrest carrier together with the slide coupling piece, and the further backrest carrier together with the further slide coupling piece, have a mirror-symmetrical design and are laterally situated on the seat support in a mirror-symmetrical manner. Such a double mirror-symmetrical configuration allows a stable implementation of the synchronous movement of the seat support and the backrest carrier that is ensured on both sides. This may be beneficial in achieving a robust design.

In preferred embodiments of the synchronous chair mechanism, all or at least one of the rotational axes are/is oriented essentially transversely and in particular approximately at right angles to a longitudinal direction of the seat support. The longitudinal direction of the seat support may correspond to a connection between its front side and rear side. The rotational axes may also extend essentially in parallel to one another.

A further aspect of the invention relates to a chair having a seat, a backrest, a substructure, and a synchronous chair mechanism as described above, wherein the seat is held by a seat support of the synchronous chair mechanism, the backrest is mounted on a backrest carrier of the synchronous chair mechanism, and the substructure is connected to a base of the synchronous chair mechanism. The effects and advantages mentioned above in conjunction with the synchronous chair mechanism may be efficiently achieved with such a chair.

BRIEF DESCRIPTION OF THE DRAWINGS

Further advantageous embodiments of the invention result from the following description of exemplary embodiments of the invention, with the aid of the schematic drawings. In particular, the synchronous chair mechanism according to the invention and the chair according to the invention are explained in greater detail based on exemplary embodiments, with reference to the appended drawings, which show the following.

Figure 1:
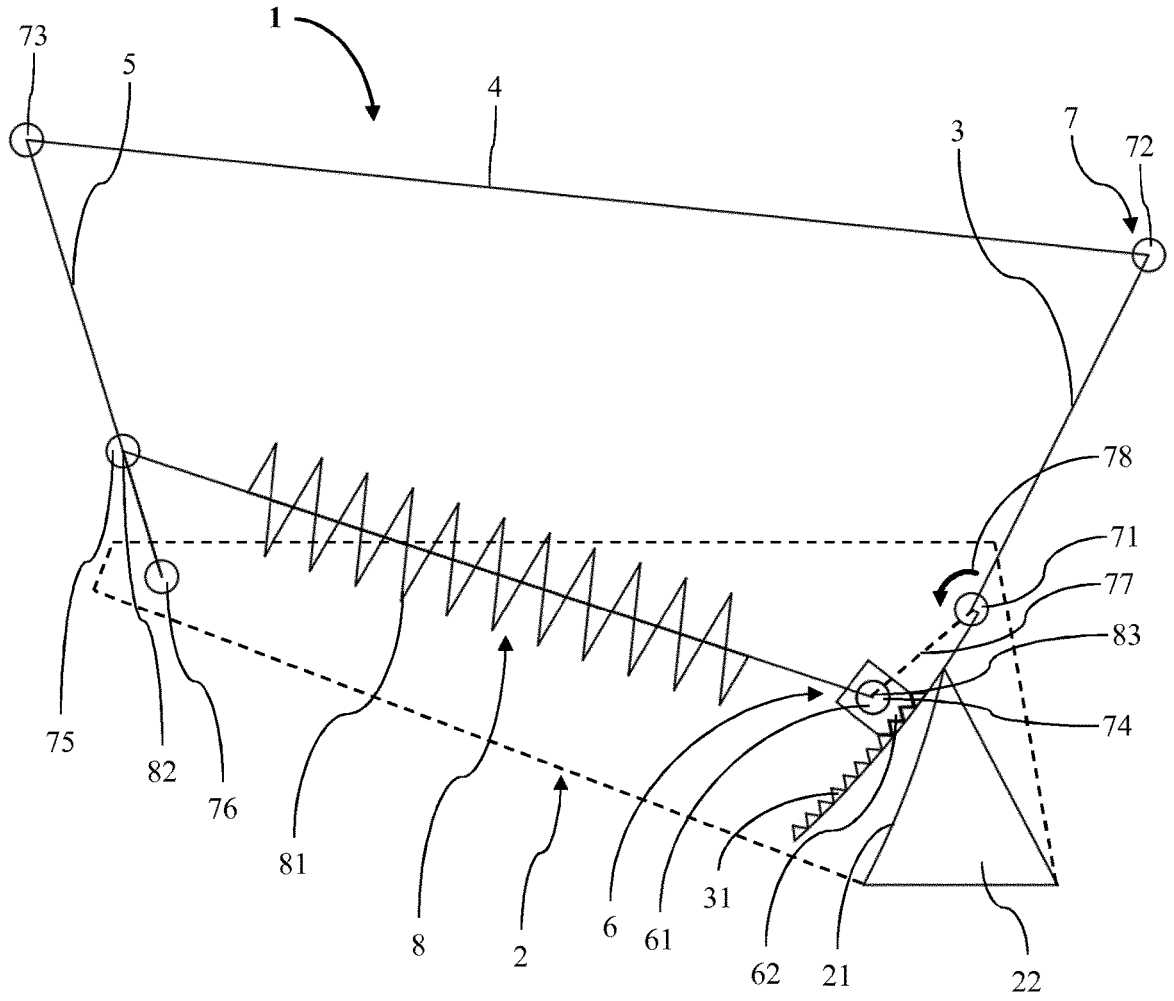
FIG. 1 shows a schematic diagram of a first exemplary embodiment of a synchronous chair mechanism according to the invention, in a position in which a relatively small supporting force for a backrest is adjusted.

Certain expressions are used in the following description for practical reasons, and are not to be construed as limiting. The words "right," "left," "bottom," and "top" denote directions in the drawings to which reference is made. The expressions "inwardly," "outwardly," "below," "above," "left," "right," or the like are used to describe the arrangement of denoted parts relative to one another, the movement of denoted parts relative to one another, and the directions toward or away from the geometric midpoint in the invention as well as designated parts thereof, as illustrated in the figures. These spatial relative indications also encompass other positions and orientations than illustrated in the figures. For example, when a part illustrated in the figures is turned upside down, elements or features that are described as "below" are then "above." The terminology includes the words expressly mentioned above, derivations of same, and words of similar meaning.

To avoid repetitions in the figures and the associated description of the various aspects and exemplary embodiments, certain features are to be understood collectively for various aspects and exemplary embodiments. The omission of an aspect in the description or in a figure does not imply that this aspect is absent in the associated exemplary embodiment. Rather, such an omission may serve to improve clarity and prevent repetitions. In this regard, the following applies for the entire further description: If reference numerals are contained in a figure for the purpose of graphical clarity, but are not mentioned in the directly corresponding text in the description, reference should be made to their explanation in the preceding description of the figures. Furthermore, if reference numerals are mentioned in the text in the description that directly corresponds to a figure, but are not contained in the associated figure, reference should be made to the preceding and subsequent figures. Similar reference numerals in two or more figures stand for similar or identical elements.

FIG. 1 shows a schematic diagram of a first exemplary embodiment of a synchronous chair mechanism 1 according to the invention, having the following basic elements: a base 2, a backrest carrier 3, and a seat support 4. The synchronous chair mechanism 1 is installed in a first exemplary embodiment of a chair according to the invention, with a substructure for setting the chair on the floor, a backrest, and a seat. The base 2 is connected to the substructure of the chair. The backrest of the chair is mounted on the backrest carrier 3. The seat of the chair is fastened to the seat support 4.

The synchronous chair mechanism 1 also has a connecting arm 5, a slide coupling piece 6, and a spring element 8 with a coil spring assembly 81, a front end 82, and a rear end 83. The coil spring assembly 81 contains multiple coil springs that extend between the front end 82 and the rear end 83.

The components of the synchronous chair mechanism 1 are connected to one another via multiple rotational axes 7 that allow ergonomic simultaneous movement of the seat and the backrest relative to one another. The backrest carrier 3 is mounted on the base 2 so as to be pivotable about a first rotational axis 71, and is mounted on the seat support 4, near its rear side 41, via a second rotational axis 72. Near its front side 42, the seat support 4 is connected to an upper longitudinal end of the connecting arm 5 so as to be pivotable about a third rotational axis 73. A lower longitudinal end of the connecting arm 5 is in turn mounted on the base 2 so as to be pivotable about a sixth rotational axis 76. The base 2, the backrest carrier 3, the seat support 4, and the connecting arm 5 thus form a quadrangle in which the four angles are flexibly adjustable via the first, the second, the third, and the sixth rotational axes 71, 72, 73, 76.

The spring element 8 at its front end 82 is fastened via a fifth rotational axis 75 to the connecting arm 5, in the lower half of the connecting arm 5 between its lower and upper longitudinal ends. At its rear end 83, the spring element 8 is pivotably connected to the slide coupling piece 6 via a fourth rotational axis 74. For this purpose, the slide coupling piece 6 is provided with a borehole 61 through which an axial rod 741 (not visible in FIG. 1) extends.

The slide coupling piece 6 is also provided with engagement teeth 62 that engage with a tooth row 31 of the backrest carrier 3. The tooth row 31 is designed as a latching structure situated vertically on the backrest carrier 3 in an area below the first rotational axis 71. The spring element 8 is thus clamped between the connecting arm 5 and the backrest carrier 3. The base 2 has a ramp unit 22 having a sliding surface 21 that extends in the direction of the slide coupling piece.

In the situation illustrated in FIG. 1, the backrest of the chair is acted on by pressure. The backrest carrier 3 is thereby tilted about the first rotational axis 71, so that the second rotational axis 72 is moved to the right and the fourth rotational axis 74 is moved to the left. The synchronous chair mechanism 1 is thus outside its zero position. The engagement teeth 62 of the slide coupling piece 6 that engage with the tooth row 31 thus fixedly connect the slide coupling piece, and thus also the rear end 83 of the spring element 8, to the backrest carrier 3. The spring element 8 is thereby compressed, and presses against the backrest carrier 3 below the first rotational axis 71. A torque 78 that acts in the counterclockwise direction at the first rotational axis 71 is thus generated on the backrest carrier 3. The distance between the first rotational axis 71 and the fourth rotational axis 74 forms an active lever 77 that concurrently determines the magnitude of the torque 78.

The slide coupling piece 6 is situated near an upper end of the tooth row 31 in FIG. 1. The distance between the first rotational axis 71 and the fourth rotational axis 74 is accordingly relatively small, so that the active lever 77 is relatively short. The torque 78 is similarly relatively low. The torque 78 in turn specifies the supporting force of the backrest of the chair, which in the situation shown in FIG. 1 is relatively small. The backrest thus has a rather soft adjustment in FIG. 1.

Figure 2:
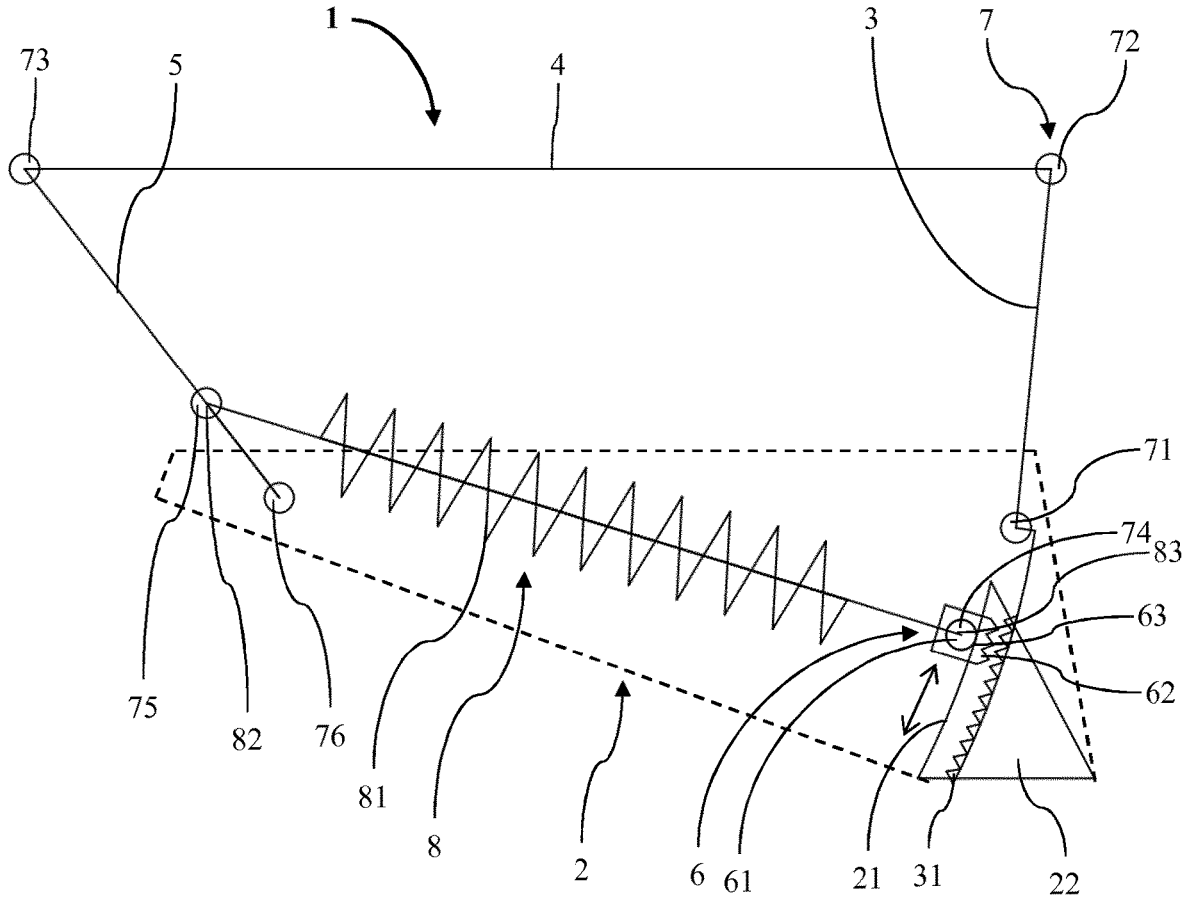
FIG. 2 shows a schematic diagram of the synchronous chair mechanism from FIG. 1, in which a spring element is decoupled from a backrest carrier.

The synchronous chair mechanism 1 is shown in its zero position in FIG. 2. The backrest of the chair is not acted on by pressure, and the backrest carrier 3 is moved counterclockwise about the first rotational axis 71, all the way to the left, by the spring element 8. The second rotational axis 72 is hereby moved to the left and the fourth rotational axis 74 is moved to the right. The second rotational axis 72 is situated quasi-vertically above the first rotational axis 71, approximately at the level of the third rotational axis 73. The seat support 4 together with the seat is thus horizontally oriented in the zero position.

Due to rotating the backrest carrier 3 counterclockwise about the first rotational axis, the area of the backrest carrier 3 below the first rotational axis 71 together with the tooth row 31 is moved to the right. The tooth row 31 is hereby situated farther to the right than the sliding surface 21 of the base 2. The slide coupling piece 6 with a mating sliding surface 63 thus rests against the sliding surface 21 of the base 2. The slide coupling piece 6 together with the spring element 8 is thus decoupled from the backrest carrier 3.

As indicated by the double arrow in FIG. 2, in the zero position of the synchronous chair mechanism 1 the slide coupling piece 6 may be moved along the tooth row 31 by sliding it with its mating sliding surface 63 along the sliding surface 21 of the base. The distance between the fourth rotational axis 74 and the first rotational axis 71 may thus be changed as needed.

Figure 3:
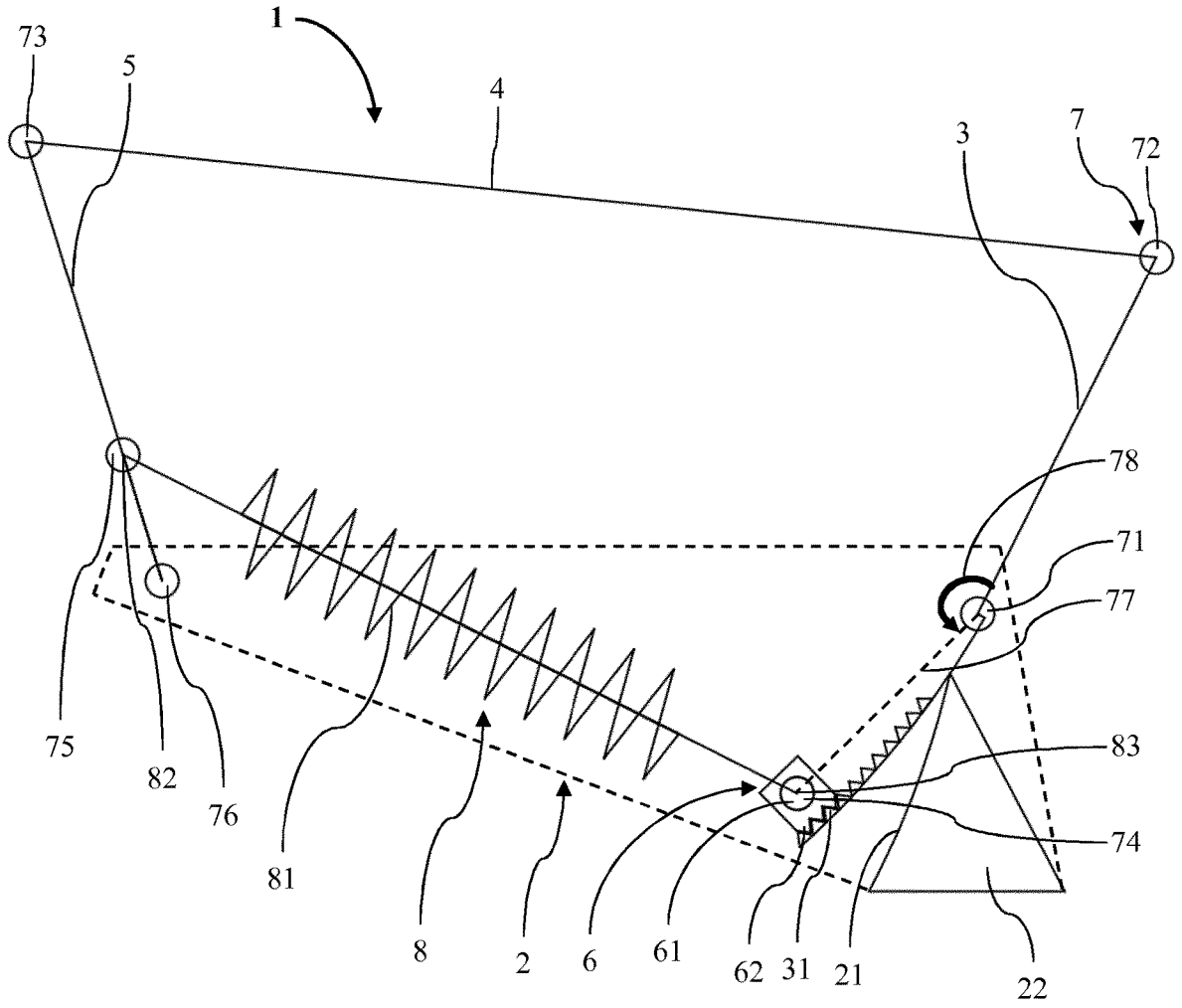
FIG. 3 shows a schematic diagram of the synchronous chair mechanism from FIG. 1, in a position in which a relatively large supporting force for a backrest is adjusted.

FIG. 3 once again illustrates the synchronous chair mechanism 1 outside the zero position. The engagement teeth 62 of the slide coupling piece 6 engage near a lower end of the tooth row 31 of the backrest carrier 3. The distance between the first rotational axis 71 and the fourth rotational axis 74 is relatively large. Accordingly, the active lever 77 is relatively long, and the torque 78 generated on the first rotational axis 71 by the spring element 8 is relatively high. The supporting force of the backrest of the seat is thus fairly large in the situation shown in FIG. 2.

Figure 4:
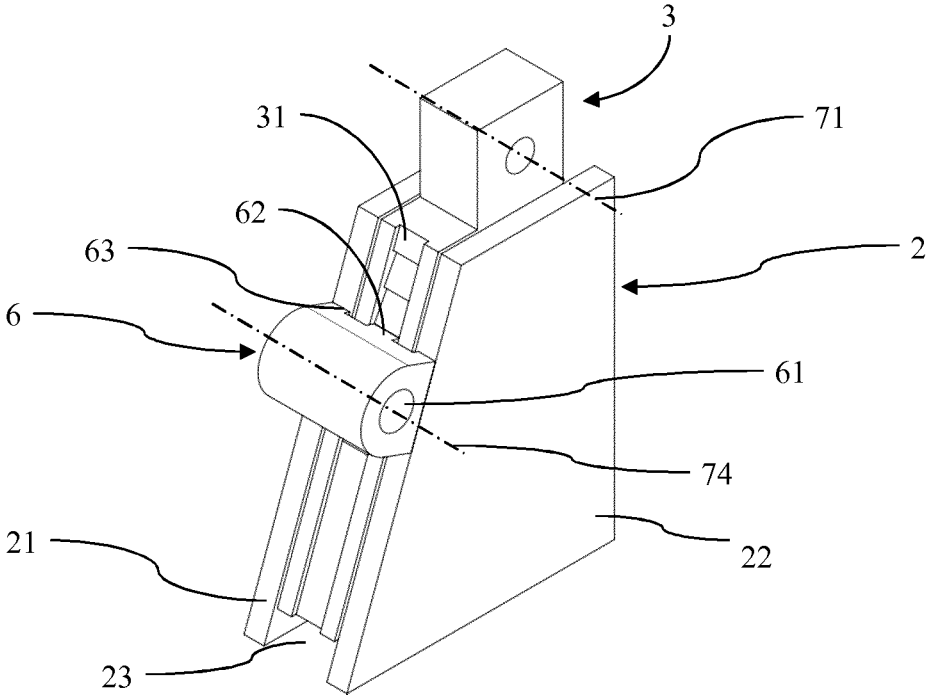
FIG. 4 shows a perspective detailed view of the backrest carrier, a base, and a slide coupling piece of the synchronous chair mechanism from FIG. 1 in its zero position.
Figure 5:
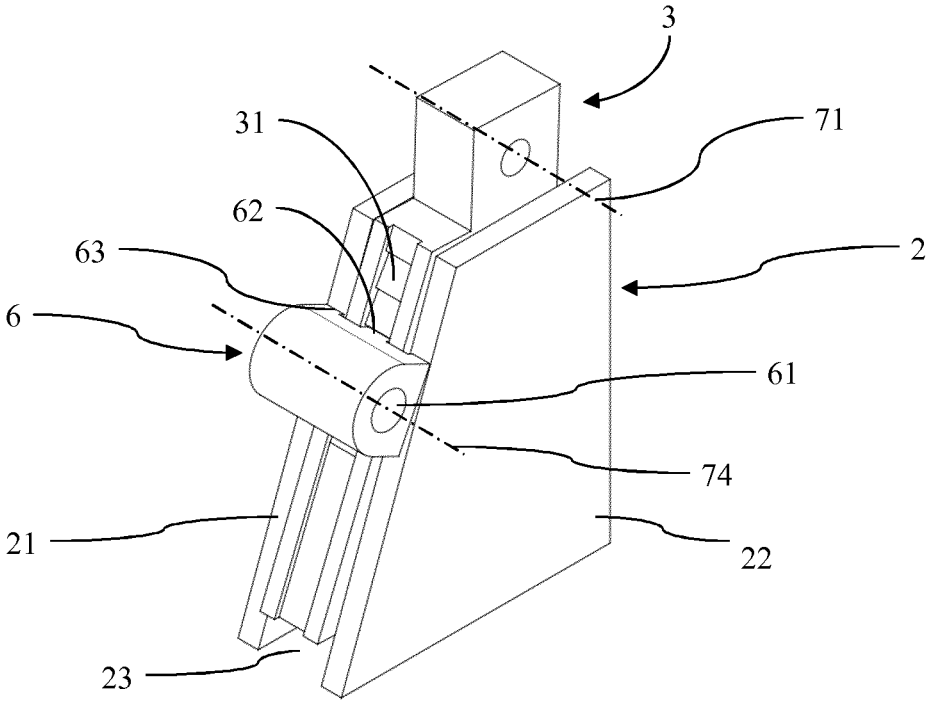
FIG. 5 shows a perspective detailed view of the components from FIG. 4 during a change from the zero position of the synchronous chair mechanism.
Figure 6:
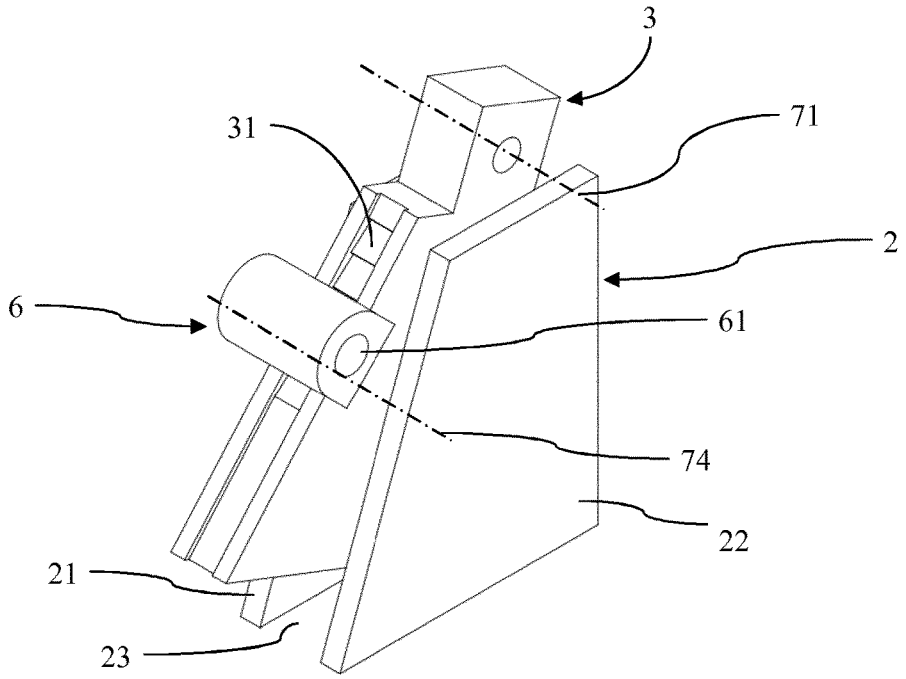
FIG. 6 shows a perspective detailed view of the components from FIG. 4 while outside the zero position of the synchronous chair mechanism.

FIGS. 4, 5, and 6 show the interaction of the base 2, the backrest carrier 3, and the slide coupling piece 6 when the synchronous chair mechanism 1 is changing from its zero position. In particular, of the base 1 and the backrest carrier 3, only the areas around the slide coupling piece 6 are illustrated for the sake of clarity.

The synchronous chair mechanism 1 is in the zero position in FIG. 4. It is apparent that the ramp unit 22 has two parallel sliding surfaces 21 and a gap 23 in between. The slide coupling piece 6, similarly as for the two sliding surfaces 21, is provided with two corresponding mating sliding surfaces 63 that extend in parallel next to the engagement teeth 62. The backrest carrier 3 is moved back and forth in the gap 23, about the first rotational axis 71, until the engagement teeth 62 are completely decoupled from the tooth row 31. In the zero position in FIG. 4, the slide coupling piece 6 may be moved along the sliding surfaces 21 and along the tooth row 31.

FIG. 5 shows the synchronous chair mechanism 1 during the coupling of the backrest carrier 3 to the slide coupling piece 6. The backrest carrier 3 is hereby tilted clockwise about the first rotational axis 71, so that the tooth row 31 is moved in the direction of the slide coupling piece 6. The engagement teeth 62 of the slide coupling piece 6 increasingly engage with the tooth row 31, and the mating sliding surfaces 63 are increasingly lifted off from the sliding surfaces 21. The slide coupling piece is thus easily tilted about the fourth rotational axis 74, so that the slide coupling piece 6 increasingly securely interlocks with the tooth row 31.

In FIG. 6, the backrest carrier 3 is tilted about the first rotational axis 71 until the slide coupling piece is completely lifted off or removed from the ramp unit 22. At the same time, the engagement teeth 62 engage firmly with the tooth row 31, so that the slide coupling piece 6 is securely and fixedly connected to the backrest carrier 30. Outside the zero position of the synchronous chair mechanism 1, displacing the slide coupling piece 6 along the backrest carrier 30, and correspondingly changing the distance between the first rotational axis 71 and the fourth rotational axis 74, is no longer possible in the situation from FIG. 6.

Figure 7:
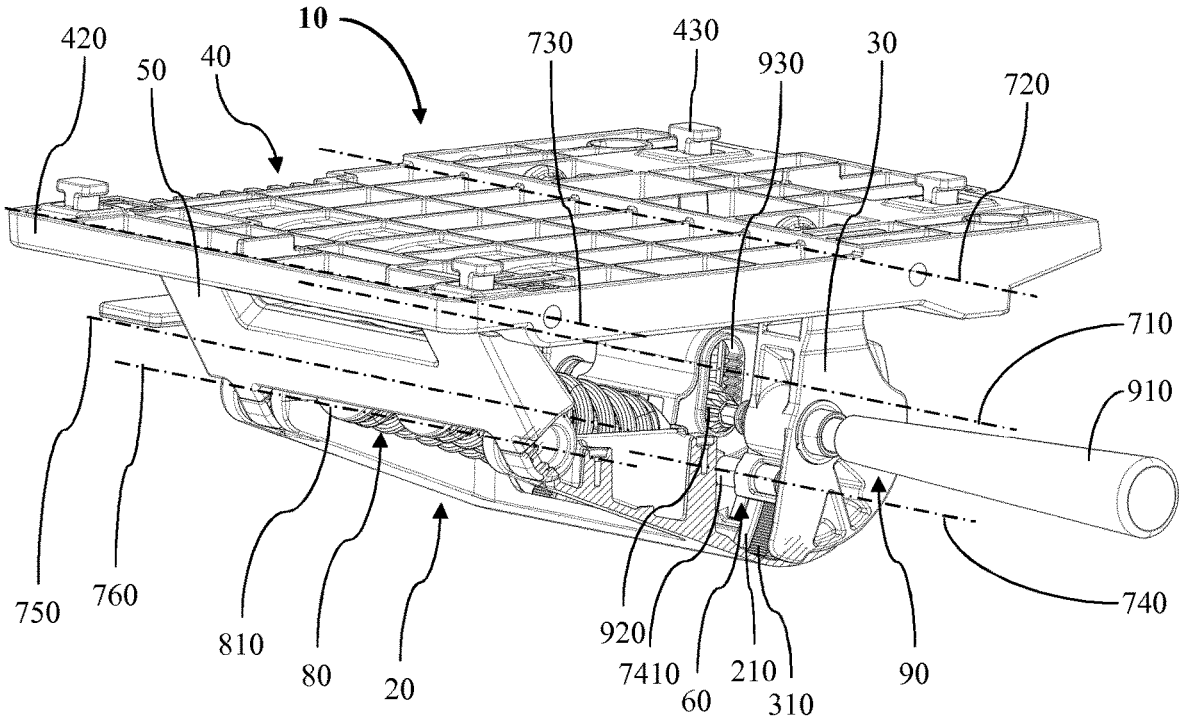
FIG. 7 shows a perspective, partially sectional view of a second exemplary embodiment of a synchronous chair mechanism according to the invention.

FIG. 7 shows a second exemplary embodiment of a synchronous chair mechanism 10 according to the invention, having the following basic elements: a base 20, a backrest carrier 30, a further backrest carrier, and a seat support 40. The synchronous chair mechanism 10 is installable in a second exemplary embodiment of a chair according to the invention, with a substructure for setting the chair on the floor, a backrest, and a seat. For this purpose the base 20 is connected to the substructure, the backrest is mounted on the backrest carrier 30, and the seat is fastened to the seat support 40.

The seat support 40 includes an essentially flat top side 440 that is equipped with four mounting feet 430 for fastening the seat, a front side 420, and a rear side 410. The base 20 is shown in a partially sectional view in FIG. 7 so that the components inside the synchronous chair mechanism 10 are visible.

The synchronous chair mechanism 10 has a connecting arm 50, a slide coupling piece 60, a further slide coupling piece, a spring element 80 with two coil springs 810, a front end, and a rear end. The coil springs 810 extend between the front end and the rear end of the spring element 80. The further slide coupling piece, the further backrest carrier, and the associated components of the base 20 have a mirror-symmetrical design with respect to the slide coupling piece 60, the backrest carrier 30, and the associated components of the base 20, and are laterally situated on the seat support 40 in a mirror-symmetrical manner.

The backrest carrier 30 is mounted on the base 20 so as to be pivotable about a first rotational axis (concealed in the figure), and is mounted on the seat support 40, near its rear side 410, via a second rotational axis 720. Near its front side 420, the seat support 40 is connected to two upper longitudinal ends of the connecting arm 50 so as to be pivotable about a third rotational axis 730. Two lower longitudinal ends of the connecting arm 50 are mounted on the base 20 so as to be pivotable about a sixth rotational axis 760. The base 20, the backrest carrier 30, the seat support 40, and the connecting arm 50 thus form a quadrangle in which the four angles may be changed via the first, the second, the third, and the sixth rotational axes 710, 720, 730, 760.

The spring element 80 at its front end is connected via a fifth rotational axis 750 to the connecting arm 50 between its lower and upper longitudinal ends. The spring element 80 at its rear end is pivotably connected to the slide coupling piece 60 via a fourth rotational axis 740. An axial rod 7410 that extends into a borehole 610 of the slide coupling piece 60 is provided for this purpose.

The slide coupling piece 60 is provided with engagement teeth 620 (not visible in FIG. 7) that may engage with a tooth row 310 of the backrest carrier 30. The tooth row 310 is designed as a latching structure from top to bottom on the backrest carrier 30, in an area below the first rotational axis 710. The spring element 80 is thus clamped between the connecting arm 50 and the backrest carrier 30. The base 20 has a rib 220 that forms a sliding surface 210 that extends in the direction of the slide coupling piece 60.

In the situation illustrated in FIG. 7, no pressure is exerted on the backrest of the chair, and the backrest or the backrest carrier 30 is not deflected or tilted backward. The synchronous chair mechanism 10 is thus in the zero position, in which the slide coupling piece 60 is displaceable along the sliding surface 210 of the base 20 and along the tooth row 310 of the backrest carrier 30.

The synchronous chair mechanism 10 has a control device 90 for displacing the slide coupling piece 60. The control device 90 includes a rotary lever 910 that is rotatably supported on the backrest carrier 30, and which toward the outside is designed as a handle.

A gearwheel 920 at its inner longitudinal end is nonrotatably situated on the rotary lever 910. The control device 90 also includes a gearwheel receptacle 930 with toothing that is fixedly connected to the fourth rotational axis 740, i.e., to the slide coupling piece 60 and the spring element 80. The gearwheel 920 is situated in the gearwheel receptacle 930, and engages with the toothing of the gearwheel receptacle 930. Rotating the rotary lever 910 causes the gearwheel 920 to rotate in the gearwheel receptacle 930. As a result, the gearwheel 920 moves up and down in the gearwheel receptacle, depending on the rotational direction. The slide coupling piece 60 in the zero position may thus likewise be moved up and down, so that a distance between the first rotational axis 710 and the fourth rotational axis 740 may be changed. In the situation shown in FIG. 7, the rotary lever 910 is rotated counterclockwise to the maximum extent, so that the slide coupling piece 60 is moved upwardly to the maximum extent.

Figure 8:
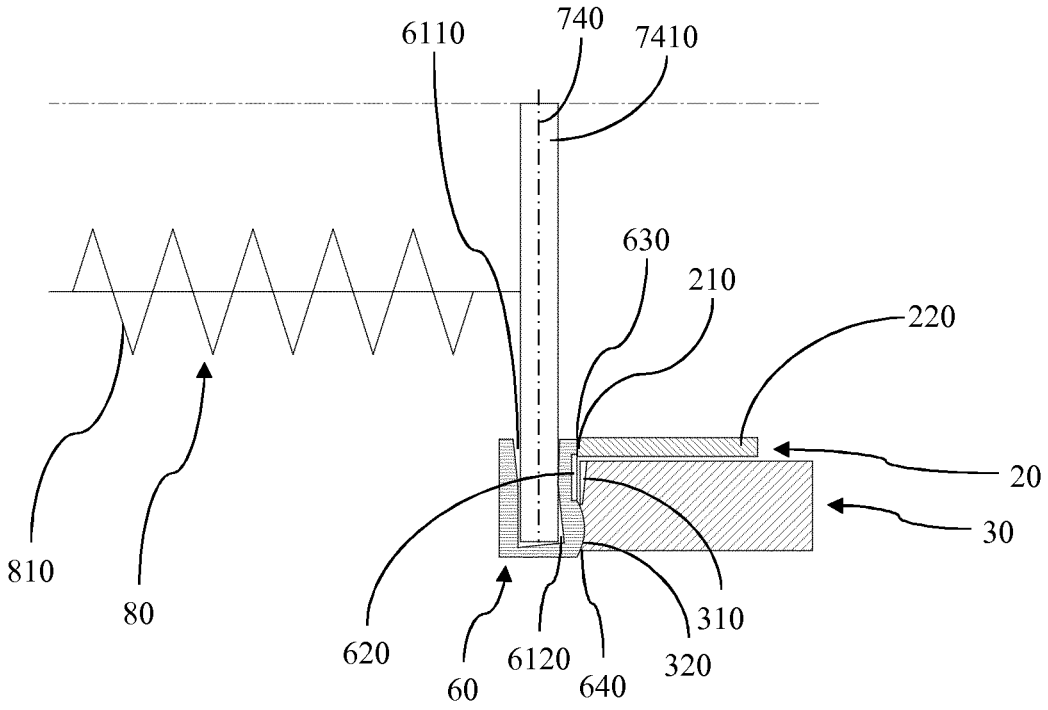
FIG. 8 shows a schematic diagram of certain components of the synchronous chair mechanism from FIG. 7 in their zero position.
Figure 9:
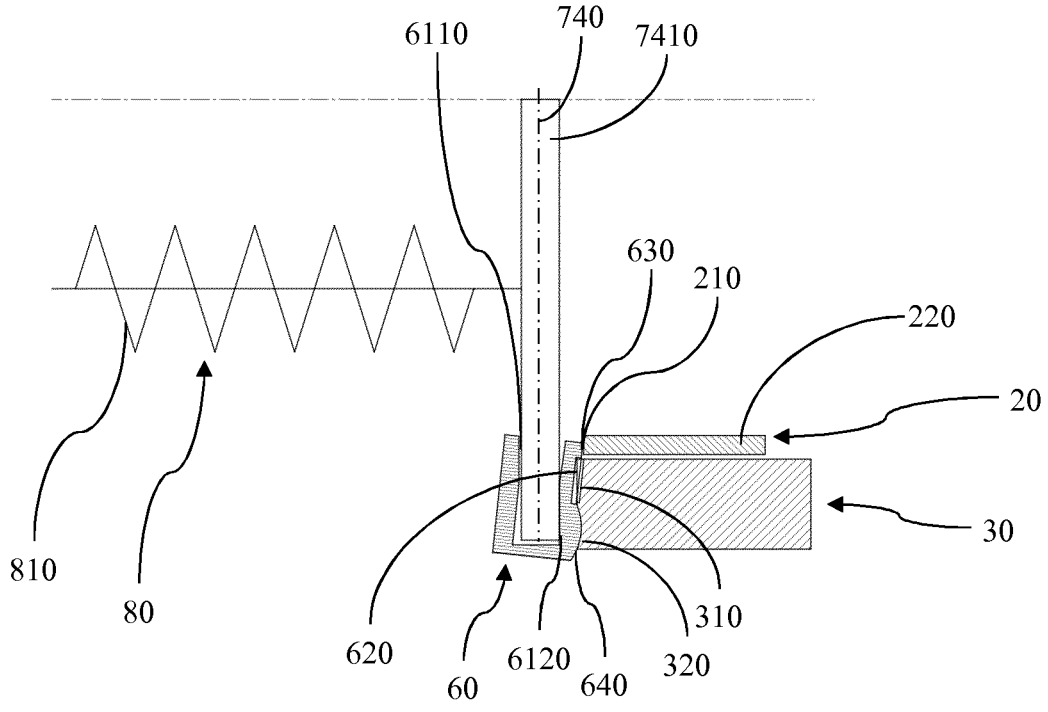
FIG. 9 shows a schematic diagram of the components from FIG. 8 during a change from the zero position of the synchronous chair mechanism.
Figure 10:
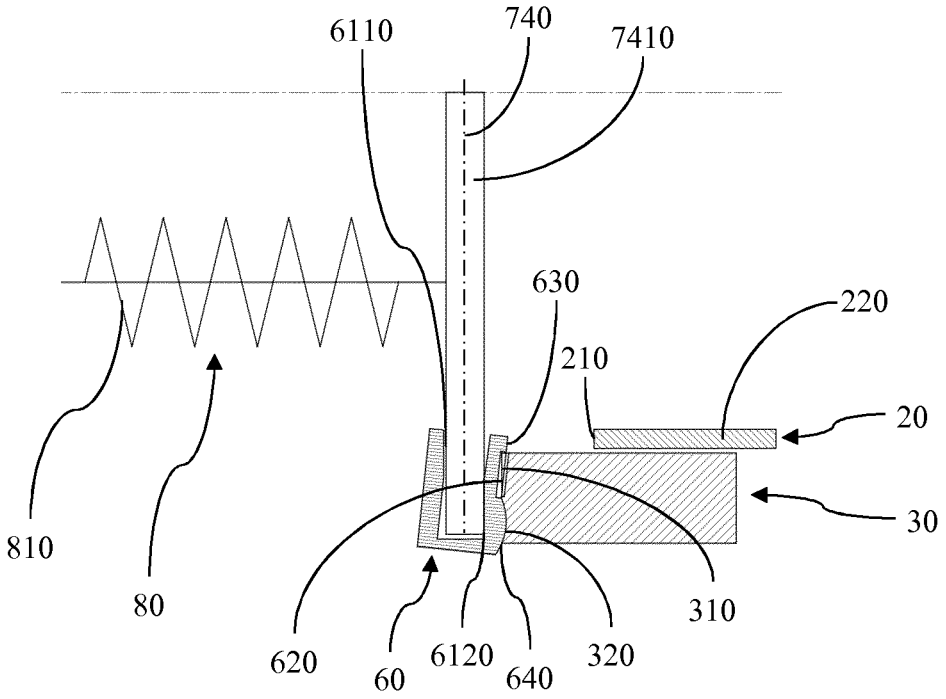
FIG. 10 shows a schematic diagram of the components from FIG. 8 outside the zero position of the synchronous chair mechanism.

FIGS. 8, 9, and 10 show the interaction of the base 20, the backrest carrier 30, and the slide coupling piece 60 while changing the synchronous chair mechanism 10 from its zero position. Of the base 10 and the backrest carrier 30, only the areas around the slide coupling piece 60 are illustrated for the sake of clarity.

The synchronous chair mechanism 10 is in the zero position in FIG. 8. The slide coupling piece 60 is illustrated in cross section, it being apparent that the slide coupling piece has a quasi-sleeve-shaped design. On its right side the slide coupling piece 60 has a mating sliding surface 630, which in the zero position rests against the sliding surface 210 of the rib 220 of the base 20. Engagement teeth 620 are formed on the right side of the slide coupling piece 60, adjacent to the mating sliding surface 630. In the zero position, the engagement teeth are adjacent to and spaced apart from the tooth row 310 of the backrest carrier 30. In turn, a convexly rounded first contact surface 640 is formed on the right side of the slide coupling piece 60, adjacent to the engagement teeth 620. The first contact surface 640 of the slide coupling piece 60 rests against a congruent, concavely rounded second contact surface 320 of the backrest carrier 30. The second contact surface 320 extends next to and along the tooth row 310.

The borehole 610 is recessed into the slide coupling piece 60 in the manner of a blind hole. The borehole toward its open side has an outer extension 6110 facing away from the mating sliding surface 630, and toward its closed side has an inner extension 6120 situated opposite from the first contact surface 640. An axial rod 7410 of the fourth rotational axis 740 extends into the borehole 610. The inner extension 6120 and the outer extension 6110 define play of the slide coupling piece 60 on the axial rod 7410, which allows the slide coupling piece 60 to be tilted to a certain extent about a tilt axis that intersects the fourth rotational axis 740 at a right angle. The axial rod 7410 is also connected to the spring element 80.

FIG. 9 shows the synchronous chair mechanism 1 during the coupling of the backrest carrier 30 to the slide coupling piece 60. The backrest carrier 30 is hereby tilted so that it moves from right to left. Via the mutually contacting first contact surface 640 and second contact surface 320, the backrest carrier 30 presses the slide coupling piece 60 away from the rib 220 of the base 20. The rounded shape of the contact surfaces 640, 320, and the outer extension 6110 and the second extension 6120, allow the slide coupling piece 60 to be rotated about the tilt axis so that the engagement teeth 620 increasingly engage with the tooth row 310.

In FIG. 10, the backrest carrier 30 is tilted about the first rotational axis 71 and moved to the left until the slide coupling piece 60 is completely removed from the rib 220. At the same time, the slide coupling piece 60 is tilted until the engagement teeth 620 firmly engage with the tooth row 310 and the slide coupling piece 60 is fixedly connected to the backrest carrier 30. Outside the zero position of the synchronous chair mechanism 10, displacing the slide coupling piece 60 along the backrest carrier 30, and correspondingly changing the distance between the first rotational axis 710 and the fourth rotational axis 740, is not possible in the situation from FIG. 7.

Although the invention is illustrated and described in detail by means of the figures and the associated description, respectively, this illustration and this detailed description are to be understood as illustrative and by way of example, and not as limiting to the invention. In certain cases, well-known structures and techniques may not be shown or described in detail so as not to overelaborate the invention. It is understood that experts in the field may make revisions and modifications without departing from the scope of the following claims. In particular, the present invention encompasses further exemplary embodiments with any combinations of features, which may differ from the feature combinations explicitly described.

The present disclosure also includes embodiments with any combination of features that are stated or shown in the preceding or subsequent discussion of various embodiments. The present disclosure likewise includes individual features in the figures, even if they are shown there in conjunction with other features, and/or are not mentioned in the preceding or subsequent discussion. In addition, the alternatives of embodiments and individual alternatives of their features that are described in the figures and in the description may be excluded from the subject matter of the invention or the disclosed subject matter. The disclosure includes embodiments that comprise only the features described in the claims or in the exemplary embodiments, as well as embodiments that comprise additional other features.

In addition, the expression "include" and derivations thereof does not exclude other elements or steps. Likewise, the indefinite article "a" or "an" does not exclude a plurality. The functions of multiple features stated in the claims may be met by one unit or one step.

The terms "essentially," "approximately," "about," and the like in conjunction with a property or a value in particular also define the exact property or the exact value. The terms "approximately" and "about" in conjunction with a given numerical value or range may refer to a value or range that is within 20%, within 10%, within 5%, or within 2% of the given value or range. None of the reference numerals in the claims is to be construed as limiting the scope of the claims.

The invention claimed is:

1. A synchronous chair mechanism for simultaneously changing a seat and a backrest of a chair from a zero position in which the backrest is tilted to a minimum extent relative to the seat, into an end position in which the backrest is tilted to a maximum extent relative to the seat, comprising:

a spring element;

multiple basic elements;

a latching structure; and a slide coupling piece, wherein the basic elements include a base that is connectable to a substructure provided for setting up the chair, the base having a base sliding surface and the slide coupling piece having a mating sliding surface, a backrest carrier on which the backrest is mountable, and a seat support that is designed for holding a seat, wherein the spring element has a front end and a rear end and is operatively connected to at least two of the basic elements, wherein the latching structure is provided on one of the basic elements, wherein the slide coupling piece is pivotably mounted on the front end of the spring element or on the rear end of the spring element, wherein outside the zero position of the synchronous chair mechanism, the slide coupling piece engages with the latching structure so that the slide coupling piece and the latching structure are fixedly connected to one another, wherein in the zero position of the synchronous chair mechanism, the slide coupling piece is decoupled from the latching structure so that the slide coupling piece is movable relative to the latching structure, as the result of which an action of the spring element may be changed, and wherein in the zero position of the synchronous chair mechanism, the mating sliding surface of the slide coupling piece rests against the base sliding surface of the base.

2. The synchronous chair mechanism according to claim 1, wherein the backrest carrier is mounted on the base so as to be pivotable about a first rotational axis, the seat support is connected to the front end of the spring element so as to articulate about a third rotational axis, the rear end of the spring element is hinged to the backrest carrier via a fourth rotational axis, and the first rotational axis, the third rotational axis, and the fourth rotational axis are different from one another.

3. The synchronous chair mechanism according to claim 1, wherein the latching structure is provided on the backrest carrier.

4. The synchronous chair mechanism according to claim 2, wherein the slide coupling piece is mounted on the rear end of the spring element so as to be pivotable about the fourth rotational axis.

5. The synchronous chair mechanism according to claim 2, wherein in the zero position of the synchronous chair mechanism, the slide coupling piece is decoupled from the latching structure of the backrest carrier so that the slide coupling piece is movable relative to the latching structure, as the result of which a distance between the fourth rotational axis and the first rotational axis may be changed in order to change the action of the spring element.

6. The synchronous chair mechanism according to claim 2, wherein the seat support is connected to the backrest carrier with articulation about a second rotational axis.

7. The synchronous chair mechanism according to claim 2, further comprising a connecting arm that is mounted on the seat support so as to be pivotable about the third rotational axis, wherein the spring element is connected to the connecting arm so as to be pivotable about a fifth rotational axis that is different from the first rotational axis, the third rotational axis, and the fourth rotational axis.

8. The synchronous chair mechanism according to claim 7, wherein the connecting arm is mounted on the base so as to be pivotable about a sixth rotational axis.

9. The synchronous chair mechanism according to claim 8, wherein a mating sliding surface against which the slide coupling piece rests when the synchronous chair mechanism is in the zero position is formed on one of the basic elements that is different from the basic element provided with the latching structure.

10. The synchronous chair mechanism according to claim 1, wherein the latching structure has a tooth row and the slide coupling piece has an engagement tooth, wherein outside the zero position of the synchronous chair mechanism, the engagement tooth of the slide coupling piece engages with the tooth row of the latching structure.

11. The synchronous chair mechanism according to claim 10, wherein outside the zero position of the synchronous chair mechanism, the mating sliding surface of the slide coupling piece is spaced apart from the base sliding surface of the base, and in the zero position of the synchronous chair mechanism the engagement tooth of the slide coupling piece is spaced apart from the tooth row of the latching structure.

12. The synchronous chair mechanism according to claim 2, further comprising a control device via which the slide coupling piece is movable along the latching structure in the zero position of the synchronous chair mechanism, so that a distance between the first rotational axis and the fourth rotational axis may be changed.

13. The synchronous chair mechanism according to claim 12, wherein the control device includes a rotary lever that is rotatably connected to the backrest carrier, a gearwheel situated on the rotary lever, and a gearwheel receptacle with toothing that is fixedly connected to the fourth rotational axis, the gearwheel engaging with the toothing of the gearwheel receptacle so that rotation of the rotary lever results in displacement of the fourth rotational axis relative to the backrest carrier.

14. The synchronous chair mechanism according to claim 6, wherein the first rotational axis is situated between the second rotational axis and the fourth rotational axis.

15. The synchronous chair mechanism according to claim 2, further comprising a further backrest carrier and a further slide coupling piece, wherein the backrest carrier together with the slide coupling piece, and the further backrest carrier together with the further slide coupling piece, have a mirror-symmetrical design and are laterally situated on the seat support in a mirror-symmetrical manner.

16. A chair having a seat, a backrest, a substructure, and a synchronous chair mechanism according to claim 1, wherein the seat is held by a seat support of the synchronous chair mechanism, the backrest is mounted on a backrest carrier of the synchronous chair mechanism, and the substructure is connected to a base of the synchronous chair mechanism.

* * * * *